US008857656B2

(12) United States Patent
Marcades et al.

(10) Patent No.: US 8,857,656 B2
(45) Date of Patent: Oct. 14, 2014

(54) SYSTEM AND METHOD FOR PORTABLE BEVERAGE HOLDING DEVICE

(71) Applicants: Dean Marcades, Miramar Beach, FL (US); Carly Marcades, Miramar Beach, FL (US)

(72) Inventors: Dean Marcades, Miramar Beach, FL (US); Carly Marcades, Miramar Beach, FL (US)

( * ) Notice: Subject to any disclaimer, the term of this patent is extended or adjusted under 35 U.S.C. 154(b) by 0 days.

(21) Appl. No.: 13/962,179

(22) Filed: Aug. 8, 2013

(65) Prior Publication Data

US 2014/0048550 A1 Feb. 20, 2014

Related U.S. Application Data

(60) Provisional application No. 61/684,635, filed on Aug. 17, 2012.

(51) Int. Cl.
*A47G 23/02* (2006.01)

(52) U.S. Cl.
CPC ..... *A47G 23/02* (2013.01)
USPC ..... 220/737

(58) Field of Classification Search
CPC .. A47G 23/0216; A47G 23/0208; A45F 3/44; B60N 3/102; B60N 3/10
USPC ..... 220/739, 737, 23.4, 475; 248/156, 147, 248/146, 311.2, 309.1; 206/217, 547, 541; D6/682, 682.1, 682.2
See application file for complete search history.

(56) References Cited

U.S. PATENT DOCUMENTS

| | | | | |
|---|---|---|---|---|
| 5,497,902 | A * | 3/1996 | Crock | 220/737 |
| 5,706,975 | A * | 1/1998 | Cronk | 220/737 |
| D396,383 | S * | 7/1998 | Hanson | D7/620 |
| 6,575,417 | B1 * | 6/2003 | Krommenakker | 248/311.2 |
| D557,929 | S * | 12/2007 | Loggins et al. | D6/417 |
| 7,516,931 | B2 | 4/2009 | Sarullo | |
| D618,074 | S * | 6/2010 | Paetsch | D7/701 |
| D657,633 | S | 4/2012 | Butler | |
| 2007/0138365 | A1 * | 6/2007 | Sarullo | 248/311.2 |

* cited by examiner

*Primary Examiner* — Robert J Hicks
(74) *Attorney, Agent, or Firm* — The Noblitt Group, PLLC

(57) ABSTRACT

A system for a beverage holding device according to various aspects of the present invention is configured to provide a receiving section for a beverage container and at least one accessory receiving area. In one embodiment, the system for a beverage holding device comprises a center receiving portion and two accessory receiving areas disposed opposite each other along an exterior surface of the center receiving portion. A stabilizing device for securing the beverage holder to the ground may extend downwardly from a base of the center receiving portion.

10 Claims, 4 Drawing Sheets

SYSTEM AND METHOD FOR PORTABLE BEVERAGE HOLDING DEVICE

CROSS-REFERENCES TO RELATED APPLICATIONS

This application claims the benefit of U.S. Provisional Patent Application No. 61/684,635, filed Aug. 17, 2012, and incorporates the disclosure of the application by reference.

BACKGROUND OF THE INVENTION

Beverages are often consumed at locations that may lead to the container holding the beverage being unstable and subject to getting tipped over resulting in spillage. For example, beverage containers such as aluminum cans, plastic or glass bottles, and drinking cups are often taken to locations such as the beach where they are susceptible to being knocked over due to wind, being impacted by objects, and/or being, positioned on generally unstable surfaces. Current options for more securely holding a beverage container have met with varying degrees of success, have focused exclusively on only the beverage container itself, and do not provide a method for holding items in addition to the beverage container.

SUMMARY OF THE INVENTION

A system for a beverage holding device according to various aspects of the present invention is configured to provide a receiving section for a beverage container and at least one accessory receiving area. In one embodiment, the system for a beverage holding device comprises a center receiving portion and two accessory receiving areas disposed opposite each other along an exterior surface of the center receiving portion. A stabilizing device configured to secure the beverage holder to the ground may extend downwardly from a base of the center receiving portion.

BRIEF DESCRIPTION OF THE DRAWINGS

A more complete understanding of the present invention may be derived by referring to the detailed description when considered in connection with the following illustrative figure. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of components configured to perform the specified functions and achieve the various results. For example, the present invention may employ various types of materials, shapes, coupling systems and the like, which may carry out a variety of functions. In addition, the present invention may be practiced in conjunction with any number of processes for maintaining a beverage container in an upright position on the ground and the system described is merely one exemplary application for the invention. Further, the present invention may employ any number of conventional techniques of manufacturing, insulating items from ambient conditions, and/or coupling items together.

Figure 1:
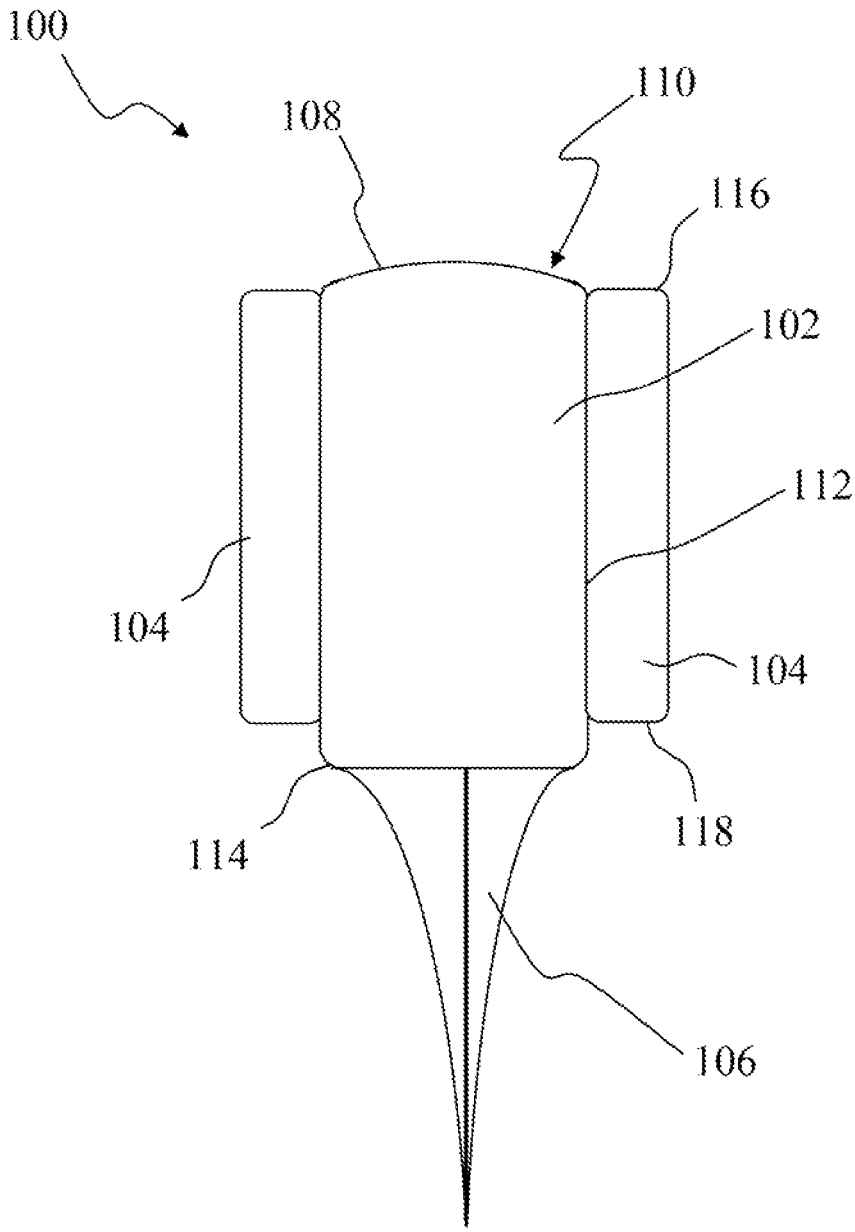
FIG. 1 representatively illustrates a side view of a beverage holding device. in accordance with an exemplary embodiment of the present invention.

Referring now to FIG. 1, in an exemplary embodiment of the present invention a portable beverage holder 100 may comprise a receiving section 102, at least one accessory receiving section 104, and a stabilizing device 106. The receiving section 102 may comprise any suitable device or system for receiving a beverage container such as a can, bottle, and/or drinking glass. For example, the receiving section 102 may comprise a substantially cylindrical tube-like structure having an open top portion 108 configured to receive the beverage container into an interior portion 110, of the receiving section 102.

The receiving section 102 may also be configured to substantially conform to the beverage container inserted into the interior portion 110. For example, in one embodiment, the receiving section 102 may comprise a flexible semi-rigid material such as neoprene, foam, or fabric that is suitably adapted to at least partially conform to the shape of the inserted beverage container. In an alternative embodiment, the receiving section 102 may comprise a substantially rigid material such as extruded or molded polyvinyl plastic that is configured to maintain its shape irrespective of the size and shape of the inserted beverage container. For example, the substantially rigid material may provide as sidewall 112 extending between the open top portion 108 and a closed base portion 114, wherein the sidewall 112 is configured to adequately support a full beverage container while also allowing for the beverage container to be easily inserted into and/or removed from the interior portion 110.

The receiving section 102 may comprise any suitable shape or size. For example, the receiving section 102 may comprise a diameter and height configured to receive a particular type of beverage container. Alternatively, the receiving section 102 may be suitably configured to receive a variety of different shaped and/or sized containers. In one embodiment, the receiving section 102 may comprise a larger height and diameter than a standard sized twelve ounce aluminum soda or beer can. In an alternative embodiment, the receiving section 102 may comprise a diameter and height suitably configured to receive a twelve to thirty-two ounce bottle such those. commonly used for water, beer, soda, sports drinks, and the like. In yet another embodiment, the receiving section 102 may be configured to receive a beverage container with a handle such as a travel mug or coffee cup.

The receiving section 102 may further be configured to insulate the inserted beverage container and may comprise any suitable method or device for reducing thermal transfer.

Figure 2:
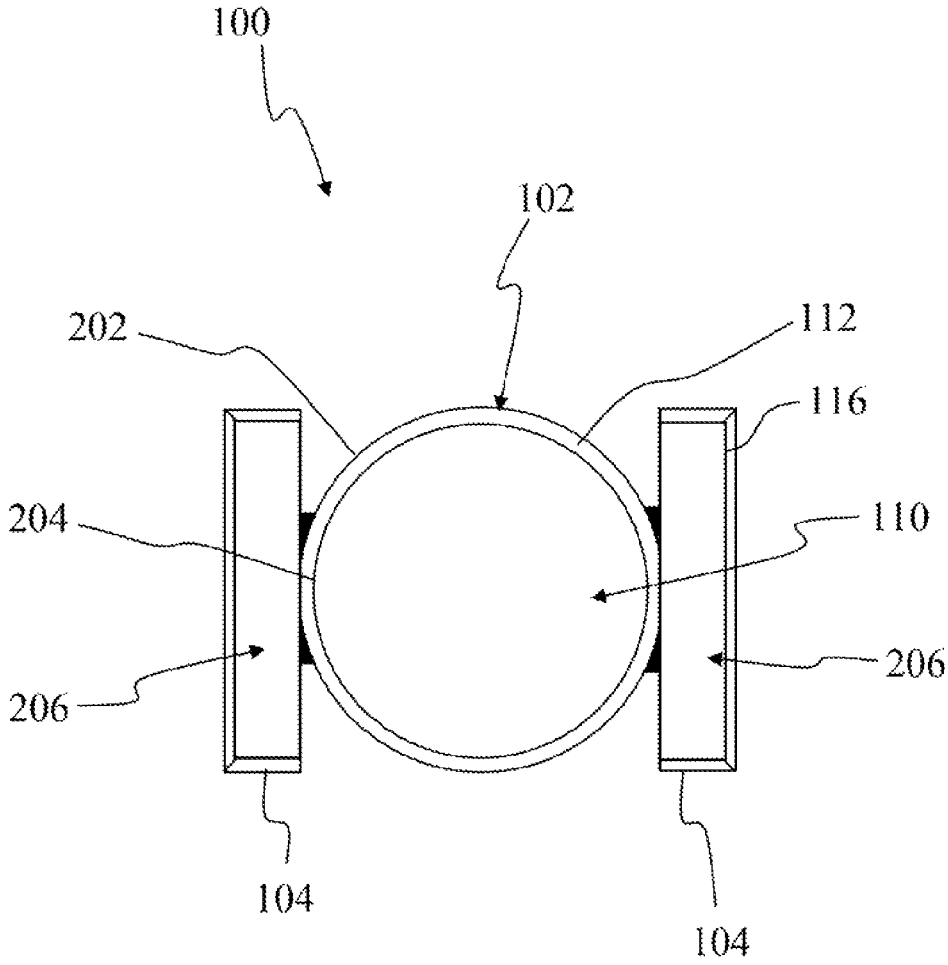
FIG. 2 representatively illustrates a top view of the beverage holding device in accordance with an exemplary embodiment of the present invention.

For example, referring now to FIG. 2, the receiving sidewall 112 may comprise an insulating material disposed between an exterior surface 202 and an interior surface 204 of the sidewall 112. The insulating material may comprise any suitable device or material suitably adapted to inhibit thermal transfer between the interior portion 110 and the environment surround the exterior surface 202. In one embodiment the insulating material may comprise an expanded foam material adapted to limit thermal transfer between the interior and exterior surfaces 204, 202 of the sidewall 112. In an alternative embodiment, the insulating material may comprise a liquid disposed between the exterior and interior surfaces 202, 204, wherein the liquid may be frozen to help reduce the rate of thermal heat loss from the inserted beverage container.

Referring now to FIGS. 1 and 2, the portable beverage holder 100 may further comprise, or otherwise be coupled to one or more accessory receiving sections 104, wherein the accessory receiving sections 104 provide additional receiving volumes 206 for the portable beverage holder 100. The accessory receiving section 104 may comprise any suitable device or system such as a pocket, a sleeve, a hook, and the like for receiving objects. For example, the accessory receiving section 104 may comprise a rectangular cuboid or pocket having an open top end 116 and a closed bottom end 118 defining a volume disposed along a portion of the exterior surface 202 of the receiving section 102 that may be suitably configured to receive items such as a wallet, keys, mobile telephone, camera, and the like. A second accessory receiving section 104 may be disposed along the exterior surface 202 of the receiving section 102 substantially opposite that of the first accessory receiving section 104.

In one embodiment, the accessory receiving section 104 may be integrated with and comprise the same material as the receiving section 102. For example, the accessory receiving section 104 and the receiving section 102 may be formed as a unitary structure from a molded or extruded polymer material such as polyvinyl chloride, polyethylene, polypropylene, and the like. In another embodiment, the accessory receiving section 104 may comprise a separate structure that is suitably adapted to be coupled to the receiving section 102 by any suitable method such as adhesively or mechanically.

Figure 3A:
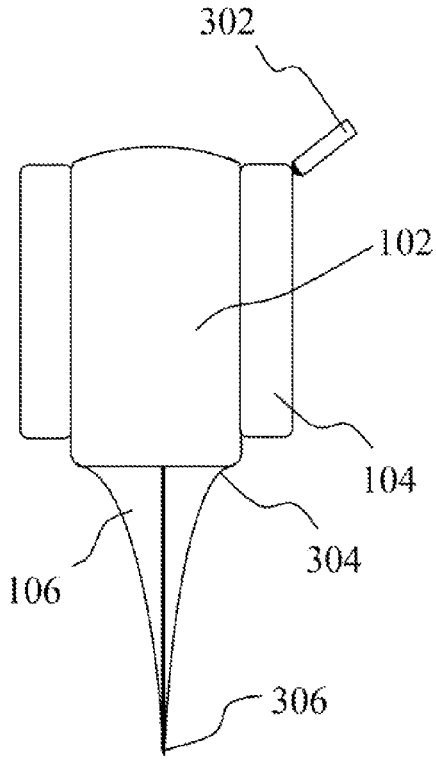
FIG. 3A representatively illustrates a cover for an accessory receiving section of the beverage holding device in an open position in accordance with an exemplary embodiment of the present invention.
Figure 3B:
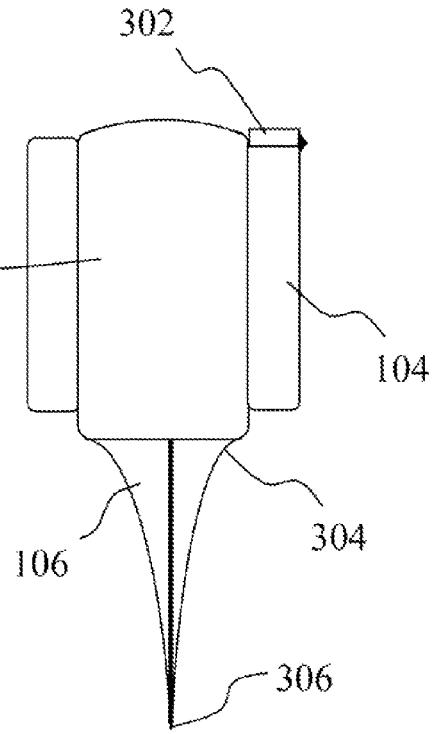
FIG. 3B representatively illustrates a cover for the accessory receiving section of the beverage holding device in a closed position in accordance with an exemplary embodiment of the present invention.
Figure 4:
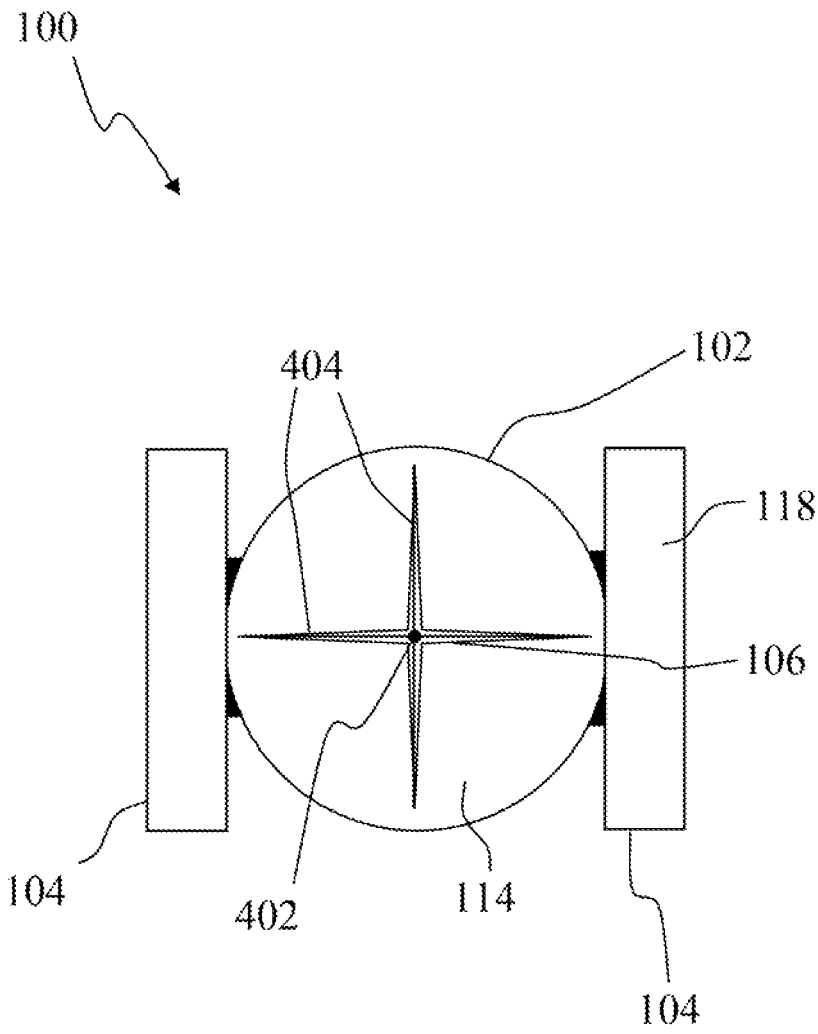
FIG. 4 representatively illustrates a bottom view of the beverage holding device in accordance with an exemplary embodiment of the present invention.

Referring now to FIGS. 3A and 3B, the accessory receiving section 104 may further comprise a cover 302. The cover 302 may comprise any suitable device or system for selectively closing off an interior portion of the accessory receiving section 104. For example, the cover 302 may be coupled to the accessory receiving section 104 by a tab that allows the cover 302 to be selectively moved from an open position to a close position. In a second embodiment, the cover may comprise a selectively removable lid portion that is suitably configured to be fit over a top portion of the accessory receiving section 104.

Referring again to FIG. 1, the stabilizing device 106 is configured to secure the receiving section 102 in a substantially upright position to reduce the likelihood that a beverage container will spill or get knocked over. The stabilizing device 106 may comprise any suitable device or system for securing the receiving section 102 in a desired position. In one embodiment, the stabilizing device 106 may comprise a protrusion such is a spike, a screw, and/or a finned body extending downward from the base portion 114 of the receiving section 102. The stabilizing device 106 may be suitably configured to be inserted into the ground to provide a stable coupling between the ground and the receiving section 102.

The stabilizing device 106 may comprise any suitable shape, size, or length to provide sufficient stability from wind, the weight of the beverage container, and/or an impact from another object. For example, in one embodiment, the protrusion 106 may comprise a rigid cone shape of between one to five inches in length to allow for insertion into the ground with sufficient depth to maintain vertical stability of the portable beverage holder 100. In a second embodiment, the stabilizing device 106 may be further configured to resist twisting when inserted into the ground. For example and referring now to FIGS. 1, 3A, 3B, and 4, the stabilizing device 106 may comprise a center axis 402 having a plurality of fins 404 extending radially outwardly from the center axis 402. The plurality of fins 404 may further be configured to taper inwardly towards the center axis 402 from a top portion 304 of the stabilizing device 106 to a bottom portion 306 of the stabilizing device 106.

The stabilizing device 106 may comprise any suitable material such as plastic, metal, reinforced composite, or the like. For example, in one embodiment, the stabilizing device 106 may comprise a polyvinyl plastic. In another embodiment, the stabilizing device 106 may be reinforced material to withstand increased forces associated with insertion of the portable beverage holder 100 into hard ground.

The stabilizing device 106 may be coupled to the receiving section 102 by any suitable method or be thrilled integral with the receiving section 102. For example, the stabilizing device 106 maybe formed as a single unitary molded or extruded structure with the receiving section 102. Alternatively, the stabilizing device 106 may be fastened to the receiving section 102 with a removable fastener to facilitate replacement of the stabilizing device 106 in the event that the stabilizing device 106 is broken.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, any connecting lines shown in the various figures are intended to represent exemplary functional relationships and/or steps between the various elements. Many alternative or additional functional relationships or physical connections may be present in a practical system.

These and other embodiments for methods of modular design may incorporate concepts, embodiments, and configurations as described with respect to embodiments of apparatus for completing a floor plan as described above. The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The invention has been described with reference to specific exemplary embodiments. Various modifications and changes, however, may be made without departing from the scope of the present invention. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same may result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage. or solution to occur or to become more pronounced are not to be construed as critical, required or essential features or components.

As used herein, the terms "comprises", "comprising", or any variation thereof, are intended to reference a non-exclusive inclusion that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to a preferred or exemplary embodiment. However, changes and modifications may be made to the preferred embodiment without departing from the scope of the present invention. These and other changes or modifications are intended to be included within the scope of the present invention, as expressed in the following claims.

The invention claimed is:

1. A portable holder for a beverage container, comprising:
- a receiving section having:
  - an open top portion;
  - a base portion; and
  - a sidewall extending between the top portion and the base portion;
- an accessory receiving section disposed along an exterior surface of the sidewall, wherein the accessory receiving section comprises:
  - an open top proximate to the open top portion of the receiving section; and
  - a closed bottom proximate to the base portion of the receiving section; and
- a stabilizing device extending downward from the base portion, wherein the stabilizing device comprises:
  - a center axis; and
  - a plurality of tins extending radially outward from the center axis, wherein the plurality of fins taper inwardly towards the center axis along an arc from a top portion of the stabilizing device proximate the sidewall to a bottom portion of the stabilizing device.

2. A portable holder for a beverage container according to claim 1, wherein the receiving section forms a substantially cylindrical tube between the open top portion and the base portion.

3. A portable holder for a beverage container according to claim 1, further comprising a second accessory receiving section disposed along the exterior surface of the sidewall.

4. A portable holder for a beverage container according to claim 3. wherein the second accessory receiving section is positioned along the exterior surface of the sidewall substantially opposite the first accessory receiving section.

5. A portable holder for a beverage container according to claim 1 wherein the accessory receiving section comprises a substantially rectangular cuboid.

6. A portable holder for a beverage container according to claim 1, further comprising a cover configured to enclose the open top of the accessory receiving section.

7. A device for receiving a beverage container, comprising:
- a tubular receiving section having:
  - an open top portion;
  - a base; and
  - an interior receiving portion disposed between the top portion and the base;
- a rectangular pocket having an open top, wherein the rectangular pocket is disposed along an exterior surface a the tubular receiving section; and
- a stabilizing device extending downward from the base portion, wherein the stabilizing device comprises:
  - a center axis; and
  - a plurality of tins extending radially outward from the center axis, wherein the plurality of fins taper inwardly towards the center axis along an arc from a top portion of the stabilizing device to a bottom portion of the stabilizing device.

8. A device for receiving a beverage container according to claim 7, further comprising a second rectangular pocket disposed along the exterior surface of the tubular receiving section.

9. A device for receiving a beverage container according to claim 8, wherein second rectangular pocket is positioned along the exterior surface of the tubular receiving section substantially opposite the first rectangular pocket.

10. A portable beverage container according to claim 7, further comprising a cover configured to enclose the open top of the rectangular pocket.

* * * * *